United States Patent [19]

Yang

[11] Patent Number: 4,766,748

[45] Date of Patent: Aug. 30, 1988

[54] KNOCKDOWN TYPE COMBINATION LOCKING DEVICE FOR SUITCASES

[76] Inventor: Yaw K. Yang, 190-30 Chang Shiu Rd., Chang-Hua City, Taiwan

[21] Appl. No.: 53,076

[22] Filed: May 21, 1987

[51] Int. Cl.[4] ..... E05B 37/02

[52] U.S. Cl. ..... 70/312; 70/316

[58] Field of Search ..... 70/69–76, 70/312, 315–318, 443, 448, 450; 242/77, 77.3, 84.8, 170; 292/337, DIG. 38; 220/4 B, 4 R

[56] References Cited

U.S. PATENT DOCUMENTS

| | | | |
|---|---|---|---|
| 3,400,226 | 9/1968 | Krumreich | 220/4 B |
| 3,439,515 | 4/1969 | Gehria | 70/317 |
| 4,554,809 | 11/1985 | Yang | 70/312 |

*Primary Examiner*—Robert L. Wolfe

*Attorney, Agent, or Firm*—Ladas & Parry

[57] ABSTRACT

The present invention relates to a knockdown type combination locking device which comprises: a housing body in the form of a rectangular structure with a hollow space for containing a dialing wheels set, a tongue at top of an end side, and two longitudinal sides each with a inclined protrusion at an end; a front plate made of plastic material by injection process, having a plurality of dialing wheel openings, a latch opening and a shifter opening on the front side and two parallel connecting plate at the bottom each with a latch openings and such connecting plate is higher at the latch opening side; a sliding member in the form of a board having a plurality of dialing wheel openings and two hooks at one end, two rectangular openings at the other end; a coupling element in the form of a U-sheet having two openings and two forked portions at a lateral side; and an operating mechanism made of plastic material by injection process having a pair of parallel pawls extending perpendicularly and each pawl has a hook for seizing to the coupling element and the sliding member at the respective openings for combination the front plate to the housing body to form a combination locking device.

11 Claims, 3 Drawing Sheets

KNOCKDOWN TYPE COMBINATION LOCKING DEVICE FOR SUITCASES

BACKGROUND OF THE INVENTION

The present invention relates to a combination lock for suitcase, particularly a knockdown type which can be assembled simply.

The present invention mainly involves assembly of combination lock, particularly an improvement on the structure of combination lock to make the assembly easy and simple. Therefore, the description below would refer mainly to the structure of combination lock with respect to its assembly, and particularly on the housing body and front plate.

Generally the prior arts are of sophisticated structures involving complicated and time-consuming assembly works, improvement on production efficiency of which is not easy, particularly on assembly of front plate, operating mechanism and code setting elements.

The present invention is an improvement on the applicant's prior art, a combination locking device for suitcase under the U.S. Pat. No. 4,554,809, that eliminates the complicated procedures for assembly of housing body and front plate, and also eliminates the inconvenience involved in riveting of operating mechanism, sliding member and coupling frame.

SUMMARY OF THE INVENTION

The main objective of the present invention is to provide a knockdown type combination locking device for suitcases by an improvement on combination lock structure so that no tool or equipment is required for its assembly and it can be assembled quickly and simply, thus, to enhancing production efficiency.

Briefly stated, the knockdown type combination locking device according to the present invention therefore comprises:

a housing body in the form of a rectangular structure with a hollow space to contain a dialing wheels set, having two longitudinal sides each with two protrusions;

a front plate made of plastic material by injection process, having a plurality of dialing wheel openings, a latch opening and two parallel connecting plates bottom along the lateral sides of the dialing wheel openings and latch opening where them the connecting plate near the latch opening side is higher than the other one, and each of the connecting plates has an opening;

a sliding member in the form of a board on which there is a plurality of dialing wheel openings, two hooks at one end and two rectangular openings at the other end;

a coupling element in the form of U-sheet having two rectangular openings and two forked portions at a side; and an operating mechanism made of plastic material by injection process having a pair of pawls in the bottom each with a hook to pass through the openings of the front plate, sliding member and coupling element to fix these three parts together.

To assemble the combination lock, it is only necessary to insert the tongue into the front plate and seize the protrusions in the openings of the coupling element to incorporate the front plate with the housing body. Detailed description is given below with reference to the attached drawings.

DETAILED DESCRIPTION OF THE PREFERRED EMBODIMENT

Figure 1:
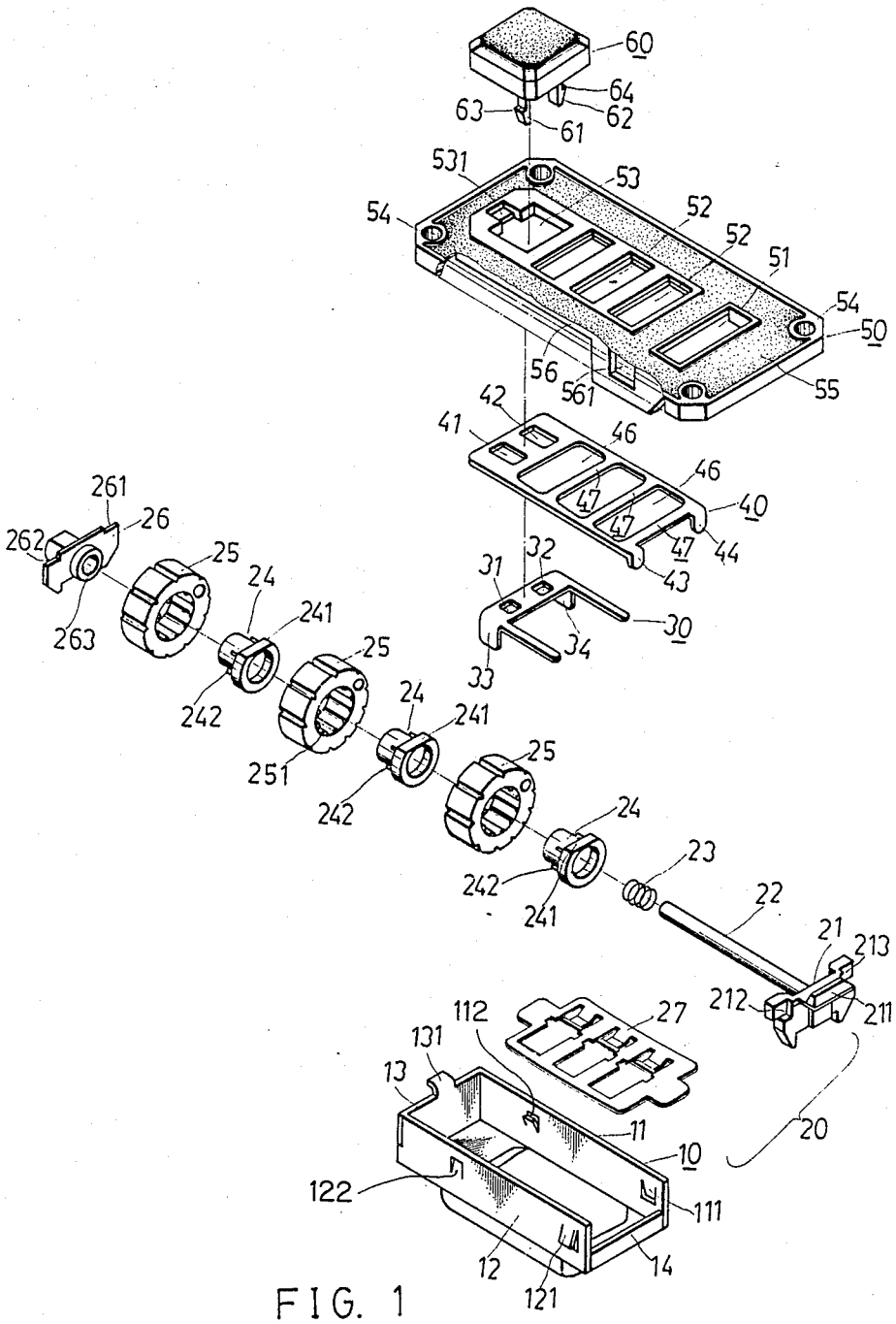
FIG. 1 is a perspective and fragmental view of a preferred embodiment of a knockdown type combination locking device for suitcases according to the present invention.

As shown in FIG. 1, the knockdown type combination locking device for suitcases according to the present invention mainly comprises a housing body (10), a set of dialing wheels (20), a coupling element (30), a sliding member (40), a front plate (50) and an operating mechanism (60). The housing body (10) is a rectangular housing made of sheet metal having two longitudinal sides (11 and 12) and two end plates (13 and 14). Each longitudinal side (11 or 12) has two protrusions (111 and 112 or 121 and 122) at both ends corresponding to each other. Such protrusions (111, 112 and 121, 122) are formed by punching outward (111 and 121) and inward (112 and 122). The end plate (13) has a tongue (131) on the top.

The dialing wheels set (20) comprises a latch device (21) with a spindle (22). The spindle (22) is incorporated with a spring (23), three actuating sleeves (24), three dialing wheels (25), an adjuster (26) and a check plate (27).

The coupling element (30) is a metal plate in the form of U having two square holes (31 and 32) at the front side and two forked portions (33 and 34) extending from its edge to drive the dialing wheels for changing of code.

The sliding member (40) is in the form of a rectangular board having a pair of rectangular holes (41 and 42) at one end and a pair of hooks (43 and 44) at the other end. In the middle of the sliding member (40) there are three rectangular dialing wheel openings (46). It is driven by the operating mechanism (60) to control the latch device for unlocking.

The front plate (50) is made of plastic material by injection process. In addition to a latch opening (51), three dialing wheel openings (52), a shifter opening (53) and fixing holes (54) at its four corners, it has a shallow recession on the front side for attachment of metal sheet (55) in other color, and two parallel connecting plates (56 and 57) along the lateral sides of the dialing wheel openings (52) and latch opening (51). The closer to the latch opening (51), the higher the connecting plates (56 and 57). Each of the connecting plates (56 and 57) has a connecting hole (561 or 571). A side of the shifter opening (53) has a cutting (531).

The operating mechanism (60) is a plastic part made by injection process. It mainly comprises two vertical and symmetrical pawls (61 and 62) on the bottom. Each of the pawls (61 and 62) has a hooked portion (63 or 64).

Assembly of the combination locking device according to the present invention does not requires any tool or equipments. Procedure of assembly is described below.

Figure 2:
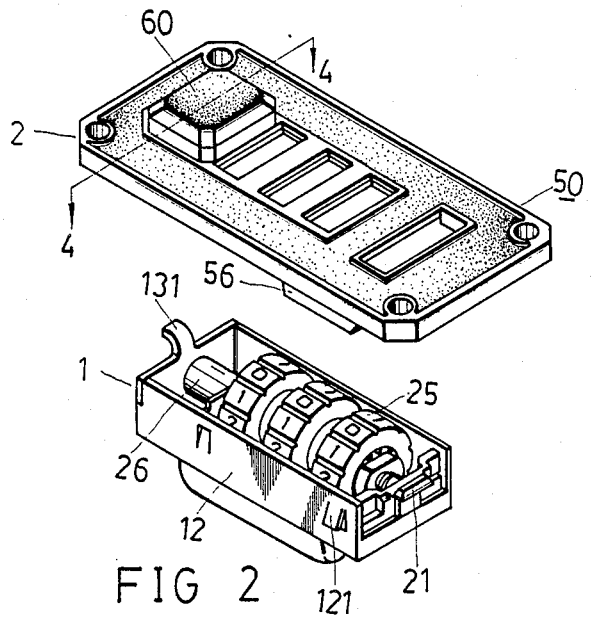
FIG. 2 is a perspective view of a partly assembled combination lock according to the present invention.
Figure 3:
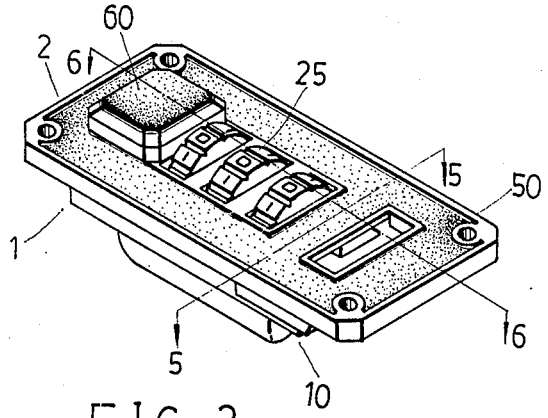
FIG. 3 is a perspective view of a final assembly of the combination lock according to the present invention.
Figure 4:
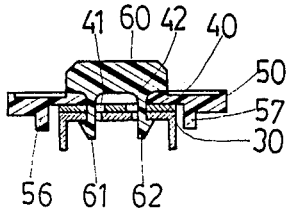
FIG. 4 is a cross-sectional view along the line 4—4 in FIG. 2.

Reference to FIG. 2, the spring (23), actuating sleeves (24), dialing wheels (25) and adjuster (26) are first engaged with the spindle (22) in that order. Then the assembly so formed and the check plate (27) are placed in the housing body (10) to complete and assembly (1) comprising the dialing wheels set. Secondly, the pawls (61 and 62) of the operating mechanism (60) are passed through the shifter opening (53) of the front plate (50), holes (41 and 42) of the sliding member (40), and holes (31 and 32) of the coupling element (30) in that order so that the hooked portions (63 and 64) are just seized in the holes (31 and 32) as shown in FIG. 4. That is, the operating mechanism (60), the front plate (50), the sliding member (40) and the coupling element (30) are assembled to form an Assembly (2).

Figure 5:
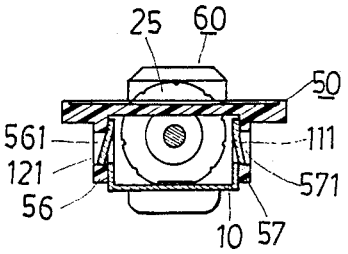
FIG. 5 is a cross-sectional view along the line 5—5 in FIG. 3.

As shown in FIGS. 2 and 5, connecting the Assembly (1) to the Assembly (2) will complete the assembly works of a combination locking device according to the present invention. For the connection the tongue (131) on the housing body (10) is inserted into and kept in the cutting (531) beside the shifter opening (53) and then the protrusions (111 and 121) on the longitudinal sides (11 and 12) of the housing body (10) are seized by the connecting holes (561 and 571) on the connecting plates (56 and 57) of the front plate (50) so that the housing body (10) and the front plate (50) are fixed together firmly. In other words, the assembly (1) and the assembly (2) are incorporated firmly to form a combination lock. The forked portions (33 and 34) of the coupling element (30) are located beside the adjuster (26), and the hooks (43 and 44) of the sliding member (40) are seized at the front end of the latch device as shown in FIG. 1.

Figure 6:
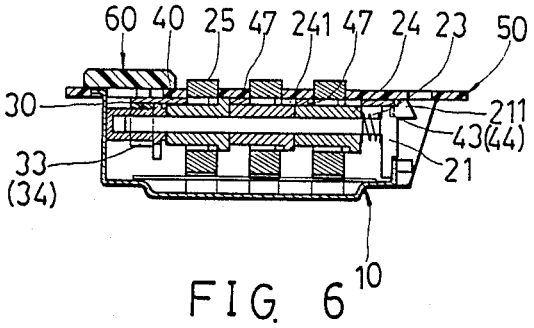
FIG. 6 is a cross-sectional view along the line 6—6 in FIG. 3 to illustrate a combination lock at locking position.

Operations of locking, unlocking and code setting change of the present invention are described below with refernce to the attached FIGS. 6 to 8.

Whenever the lug (211) extension of the latch device (21) is engaged with a hook (not shown in the drawing) attached to suitcase cover, the combination lock is in locking condition, under which the latch device (21) is normally subject to pressure extended by the spring (23) and locking status is maintained. Whenever the hook on suitcase cover is pressed downwards, the latch device (21) retracts first and then it is forced by the spring (23) to resume its original position so that the lug (211) is kept engaged with the hook to lock the suitcase. By means of the operating mechanism (60) the sliding member (40) can be displaced so that the hooks (43 and 44) are engaged with the slots (212 and 213) of the latch device (21) and thus move the latch device (21). If any of the dialing wheels (25) is not set at the correct code position, plane (241) of its corresponding actuating sleeve (24) is not at horizontal level and thus the actuating sleeve (24) restricts movement of the sliding member (40) by keeping contact with a rib (47) of the sliding member (40), and moving of the sliding member is thus restricted, the latch device (21) can't be moved to unlock the combination lock.

The spindle (22) according to the present invention is a round, straight and smooth bar formed as an integrated part of the latch device (21). It is characterized by the latch device (21) which can be retracted by compressing the spring (23) so that the lug (211) can engage with hook attached to suitcase cover at any time regardless of dialing wheel code position. This feature eliminates the need for setting dialing wheels at preset code positions prior to locking combination lock.

Figure 7:
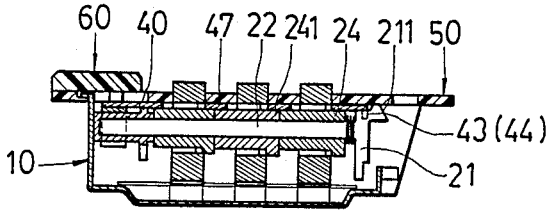
FIG. 7 is a cross-sectional view along the line 6—6 in FIG. 3 to illustrate a combination lock at unlocking position.

Please refer to FIG. 7 which illustrates a combination lock according to the present invention at unlocking condition. When all dialing wheels are at correct code positions, planes (241) of all actuating sleeves (24) are on a horizontal level so that operation of the operating mechanism (60) can displace the sliding member (40) and thus the hooks (43 and 44) can seize the slots (212 and 213) to retract the latch device (21) and consequently unlock the combination lock.

Figure 8:
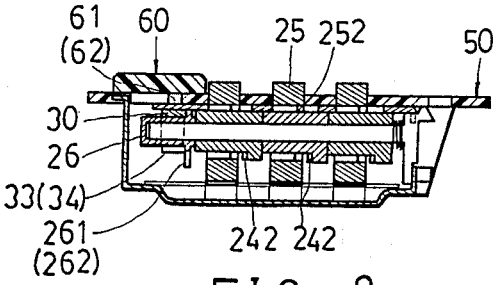
FIG. 8 is a cross-sectional view along the line 6—6 in FIG. 3 to illustrate code setting position of a combination lock according to the present invention.

For change of code setting, please refer to FIG. 8. First of all, the dialing wheels (25) must be rotated to their respective preset code positions. Then, pulling the operating mechanism (60) towards the dialing wheels (25) so that the pawls (61 and 62) move the coupling element (30) and consequentially two forked portions (33 and 34) below the coupling element (30) contact with the sides (261 and 262) of the adjuster (26), the adjuster (26) is moved toward the dialing wheels (25), and a flange (263) moves all of the actuating sleeves (24) simultaneously till teeth (242) are disengaged from the teeth (251) of the dialing wheels (25). Then, the dialing wheels (25) can have their respective code settings changed. After changing the code settings, the operating mechanism (60) is released to resume the actuating sleeves (24) to their respective original positions to complete code setting change procedure.

Locking, unlocking and code setting change of the combination lock according to the present invention are similar to that under U.S. Pat. No. 4,554,809. and are described herein for reference only.

From the above description we can see that the present invention does not require any tool or equipment for assembly of combination lock. This feature eliminates the need of rivets and sophisticated structure for prior arts, which always require mechanical equipments for riveting.

I claim:

1. A combination lock for suitcases comprising:

a generally hollow and rectangular housing having two longitudinal sides;

a front plate having a plurality of openings and cooperating with said housing;

a generally flat sliding member having a plurality of openings and cooperating with said front plate, said sliding member located between said front plate and said housing;

a generally U-shaped coupling element having openings in its surface and cooperating with said front plate, said coupling element lying between said sliding member and said housing;

a generally block-shaped operating mechanism comprised of a pair of pawls extending from the bottom of said operating mechanism and perpendicular to said bottom, each of said pawls having a hooked portion and passing through at least one opening in each of said front plate, sliding member and coupling element to firmly secure said members together while being operable for the displacement of said operating mechanism; and a combination locking means operable by said operating mechanism and positioned between the housing and said coupling element, said means passing partially through the openings defined in said sliding member, front plate and coupling element.

2. The combination lock as claimed in claim 1, wherein the housing has a first pair of protrusions, one protrusion at one end of each of said longitudinal sides, said protrusions extending outwardly of said housing and away from said front plate, and formed by punching out a section of said longitudinal sides; and parallel connecting plates attached to opposite sides of said front plate and generally perpendicular thereof, each of said plates defining in its surface an opening for engagement with one of said first pair of protrusions, to facilitate assembly of said housing and said front plate.

3. The combination lock as claimed in claim 2, wherein said combination locking means comprises:

a latch device;

a spindle attached to and an integral part of said latch device;

a spring surrounding said spindle and cooperating with said latch device;

a plurality of actuating sleeves and dialing wheels separately surrounding said spindle and biased by said spring against one another to rotate with one another, said wheels and sleeves cooperating with said latch device to provide a combination code set to operate the combination lock;

an adjuster surrounding said spindle and cooperating with said assembly of front plate, sliding member and coupling element such that movement of said operating mechanism causes said adjuster to interact with said sleeves and said wheels to release said sleeves from rotation with said wheels for resetting the lock combination; and a check plate with means to control the one-way rotation of the dialing wheels, said check plate positioned inside said housing and rotatably receiving said dialing wheels.

4. The combination lock as claimed in claim 3, wherein said longitudinal sides of said housing have a second pair of protrusions generally protruding inwardly of said housing toward said front plate and formed by punching in a section of said longitudinal sides, said protrusions assisting the positioning of said check plate inside of said housing.

5. The combination lock as claimed in claim 4, wherein said front plate has a plurality of openings to receive said dialing wheels, said latch device, adn said operating mechanism.

6. The combination lock as claimed in claim 5, wherein said coupling element has a pair of forked portions extending perpendicularly from the base of said U, said forked portions cooperating with said panels of the operating mechanism and said adjuster of said combination locking means such that movement of said operating mechanism moves said forked portions which in turn move said adjuster for disengagement of said actuating sleeves from said dialing wheels.

7. The combination lock as claimed in claim 6, further comprising two hooks perpendicular to and integral with one end of said sliding member, said hooks cooperating with said latching device of said combination locking means to retract said latching device and consequentially to unlock the combination lock.

8. The combination lock as claimed in claim 7, wherein said parallel connecting plates attached to opposing sides of the front plate increase in height as they get closer to the end of the front plate.

9. The combination lock as claimed in claim 8, wherein said front plate has a shallow recession about its periphery on the front side of said front plate for attachment of a decorative sheet.

10. The combination lock as claimed in claim 9, wherein said latch device of the combination locking means has a lug extending from its mid point and two slots at its two lateral sides for engaging with said hooks of said sliding member such that said latch device is freely retractable so that the locking device is operable regardless of the code positions of the dialing wheels.

11. The combination lock as claimed in claim 10, wherein said front plate is made of plastic material and injection molded.

* * * * *